United States Patent [19]

Takeda et al.

[11] Patent Number: 4,711,148

[45] Date of Patent: Dec. 8, 1987

[54] FRACTIONAL RANGE SELECTABLE MUSICAL TONE GENERATING APPARATUS

[75] Inventors: Fumiteru Takeda; Katsuhiko Hirano; Yoshihiro Inagaki, all of Hamamatsu, Japan

[73] Assignee: Nippon Gakki Seizo Kabushiki Kaisha, Shizuoka, Japan

[21] Appl. No.: 797,442

[22] Filed: Nov. 13, 1985

[30] Foreign Application Priority Data

Nov. 14, 1984 [JP] Japan ..... 59-172779[U]

[51] Int. Cl.[4] ..... G10H 1/18; G10H 1/36

[52] U.S. Cl. ..... 84/1.01; 84/453; 84/478

[58] Field of Search ..... 84/1.01, 1.24, 453, 84/478, 1.03, DIG. 12, DIG. 22

[56] References Cited

U.S. PATENT DOCUMENTS

| | | | |
|---|---|---|---|
| 3,643,000 | 2/1972 | Andersen | 84/1.01 |
| 4,226,154 | 10/1980 | Easler | 84/1.01 |
| 4,448,103 | 5/1984 | Blakely et al. | 84/1.01 |

*Primary Examiner*—Stanley J. Witkowski

*Attorney, Agent, or Firm*—Spensley Horn Jubas & Lubitz

[57] ABSTRACT

A musical tone generating apparatus of an adapter type to be connected to a host electronic keyboard musical instrument via an information cable for generating musical tone signals in accordance with key information supplied from the host musical instrument. The musical tone generating apparatus comprises switches for designating a fractional key range in the keyboard and generates a musical tone signal only when a key within the designated key range is depressed. A plurality of musical tone generating apparatuses of the same construction as the aforesaid musical tone generating apparatus can be connected in a cascade fashion to a single host electronic keyboard musical instrument.

9 Claims, 15 Drawing Figures

FRACTIONAL RANGE SELECTABLE MUSICAL TONE GENERATING APPARATUS

BACKGROUND OF THE INVENTION

1. Field of the Invention

This invention relates to a musical tone generating apparatus for use with an electronic keyboard musical instrument, and more particularly to such a tone generating apparatus of an adapter type as is connected to a host electronic musical instrument via a data cable to enhance tone richness of music performance.

2. Prior Art

There has been proposed a musical tone generating apparatus of the kind which is adapted to be connected via a data line to a host electronic keyboard musical instrument for generating musical tone signals in response to depressions of the keys on the keyboard of the master keyboard musical instrument. A musical tone generating apparatus of this kind is disclosed in the published specification of Japanese Utility Model Application Laid-Open No. 56-3587. Such a musical tone generating apparatus is used to generate musical tone signals, separately from those produced by the keyboard musical instrument, in accordance with key information supplied from the electronic keyboard musical instrument to thereby make the produced musical sounds more profound and rich as a whole performance. Such a musical tone generating apparatus is generally manufactured and sold separately from the electronic keyboard musical instrument.

The conventional musical tone generating apparatus of the above type is so constructed that musical tone signals are generated respectively in response to any depressed ones among all of the keys in the keyboard of the electronic keyboard musical instrument. And therefore, with the conventional musical tone generating apparatus, it has not been possible for the player to play the keyboard musical instrument more freely by restricting the musical tone signals generated by the musical tone generating apparatus to those which correspond to keys within a desired key range (compass) in the keyboard.

SUMMARY OF THE INVENTION

It is therefore an object of the present invention to provide a musical tone generating apparatus in which tone signals generated thereby can be restricted to those which correspond to keys within a desired fractional key range in a keyboard of an electronic keyboard musical instrument.

According to an aspect of the present invention, there is provided a musical tone generating apparatus responsive to key information supplied thereto for generating musical tone signals in accordance with the supplied key information comprising key range designation means for designating a fractional key range to be sounded; determination means for determining whether the supplied key information corresponds to a key within the designated key range to output a determination result; selector means for selectively outputting the key information in accordance with the determination result; and tone signal generating means responsive to the selectively outputted key information to generate musical tone signals corresponding thereto.

DESCRIPTION OF THE EMBODIMENT OF THE INVENTION

Figure 1:
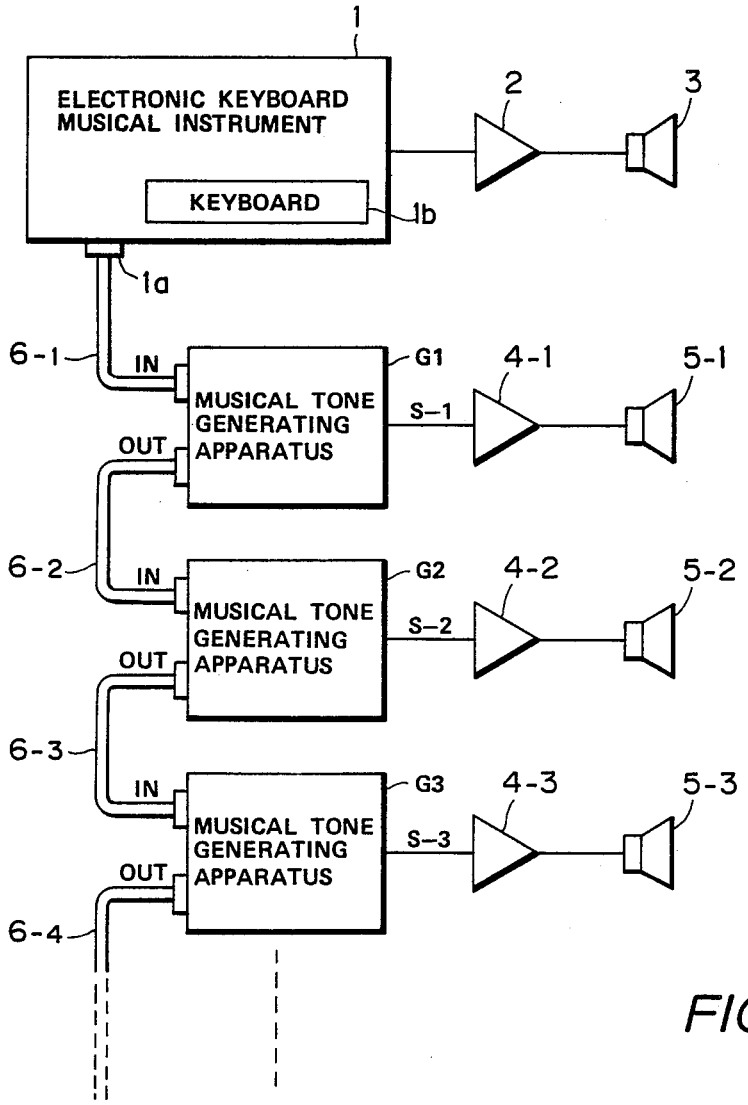
FIG. 1 is a block diagram of an electronic keyboard musical instrument system in which musical tone generating apparatuses G1, G2, G3, . . . each provided in accordance with the present invention are used as adapters to a host electronic musical instrument.

FIG. 1 shows a block diagram of an electronic musical instrument system in which a plurality of musical tone generating apparatuses G1, G2, G3, . . . each provided in accordance with the present invention are used. In FIG. 1, shown at 1 is a well-known electronic keyboard musical instrument which generates musical tone signals and supplies the generated musical tone signals to an amplifier 2. The amplifier 2 amplifies the musical tone signals and feeds the amplified musical tone signals to a loudspeaker 3 to thereby produce musical sounds. The electronic keyboard musical instrument 1 is provided with an electronic terminal (data outlet) 1*a* for outputting key information (data signal indicative of depressed keys) generated therein and a keyboard 1*b*. When a key on the keyboard 1*b* of the electronic keyboard musical instrument 1 is depressed, a key code signal KC representative of the name of the depressed key and a key-on signal KON indicative of the depression of the key are outputted in a pair from the instrument 1 through the electric terminal 1*a*. On the other hand, when a depressed key is released, a key code signal KC representative of the name of the released key and a key-off signal KOFF indicative of the release of the depressed key are outputted in a pair from the instrument 1 through the electric terminal 1*a*. These signals are generated at every moment of change in key manipulations according to a known "event data processing fashion". Each of the musical tone generating apparatuses G1, G2, G3, . . . is provided with an input terminal (data inlet) IN and an output terminal (data outlet) OUT which are internally connected to each other. The terminal 1*a* of the electronic keyboard musical instrument 1 is connected to the input terminal IN of the first musical tone generating apparatus G1 by a signal cable 6-1, and the output terminal OUT of this first musical tone generating apparatus G1 is connected to the input terminal IN of the second musical tone generating apparatus G2 by a signal cable 6-2. In the similar manner, the second to the last musical tone generating apparatuses G2, G3, . . . are connected by signal cables 6-3, 6-4, . . . in a cascade fashion. Thus, the key information outputted from the electronic keyboard musical instrument 1 through the terminal 1*a* is supplied to all of the musical tone generating apparatuses G1, G2, G3, . . . simultaneously. Musical tone signals S-1, S-2, S-3, . . . generated by the musical tone signal generating apparatuses G1, G2, G3, . . . are amplified by amplifiers 4-1, 4-2, 4-3, . . . and thence supplied to loudspeakers 5-1, 5-2, 5-3, . . . , respectively, to thereby produce musical sounds. The musical tone generating apparatuses G1, G2, G3, . . . may be mounted together on a rack or installed separately.

Figure 2:
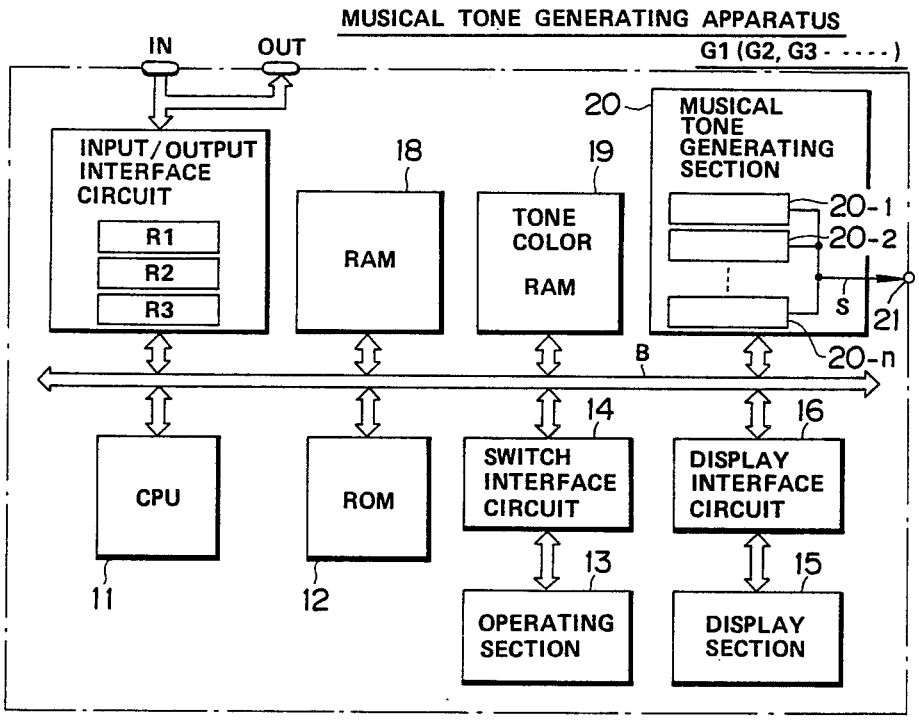
FIG. 2 is a block diagram of each of the musical tone generating apparatuses G1, G2, G3, . . . in the system of FIG. 1.
Figure 3:
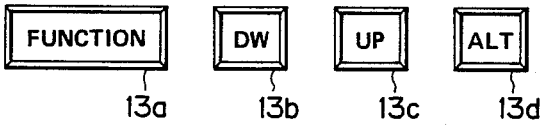
FIG. 3 is an illustration showing switches provided in the operating section 13 of the tone signal generating apparatus of FIG. 2.

FIG. 2 shows a block diagram of each of the musical tone generating apparatuses G1, G2, G3, . . . In FIG. 2, shown at 11 is a CPU (central processing unit) which is connected through a data bus B to a ROM 12 storing programs to be executed by the CPU 11 and is also connected to an operating section 13 via a switch interface circuit 14. The operating section 13 is provided, as shown in FIG. 3, with a function switch 13*a*, a down-command switch 13 b an up-command switch 13*c* and an alteration switch 13*d*. The operating section 13 is also provided with tone-color selection switches for designating a tone color of a musical tone to be generated, a power switch and so on, although those are not shown in the figure. Output signals of the aforesaid switches are outputted through a switch interface circuit 14 onto the data bus B. Shown at 15 in FIG. 2 is a display section which includes a display device such as a liquid crystal display device, and this display section 15 is connected through a display interface circuit 16 to the data bus B. An input/output interface circuit 17 comprises registers R1, R2 and R3 and stores key code signals KC, key-on signals KON and key-off signals KOFF received through the input terminal IN into the registers R1, R2 and R3, respectively. A RAM 18 is provided for storing temporary data signals, and a tone-color RAM 19 is provided for storing parameters previously determined with respect to each of various tone colors. A musical tone generating section 20 includes a plurality of tone generating channels 20-1 to 20-n each comprising a tone generating circuit of an FM type, a filter type or the like and supplies the generated tone signals, as the tone signal S, to an output terminal 21 which is connected to the corresponding amplifier 4. Each of the tone generating channels 20-1 to 20-n is supplied with the parameters stored in the tone-color RAM 19 and generates, in accordance with the supplied parameters, a musical tone signal of the tone color corresponding to the supplied parameters. Thus, the musical tone generating section 20 can simultaneous generates a plurality of tone signals corresponding respectively to different keys on the keyboard 1*b*.

The operation of the musical tone generating apparatus G1, G2, G3, . . . will now be described. Each of the musical tone generating apparatuses G1, G2, G3, . . . operates in one of the following three operation modes.

(1) Tone-color selection mode

Figure 4:
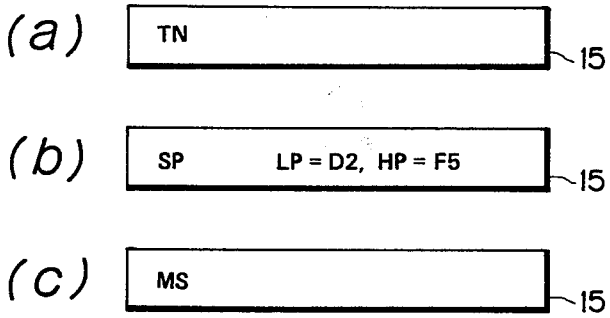
FIGS. 4-(*a*) to 4-(*c*) are illustrations showing examples of the displays made on the display section 15 of the apparatus of FIG. 2.

When the power is supplied to the electronic musical instrument system, a display is made on the display section 15 of the musical tone generating apparatus G as shown in FIG. 4-(*a*). The display of characters "TN" indicates that the apparatus G is now operating in the tone-color selection mode. If the operator depresses one of the tone-color selection switches on the operating section 13, those of the parameters which correspond to the tone color designated by the depressed tone-color selection switch are read from the tone-color RAM 19 and transferred to the musical tone generating section 20.

(2) Key range setting mode

If the operator depresses the function switch 13*a* of the operating section 13 once under condition that the display shown in FIG. 4-(*a*) is being made, the display on the display section 15 is changed to that shown in FIG. 4-(*b*). The characters "SP" displayed on the display section 15 indicate that the apparatus G is now operating in the key range setting mode. In this key range setting mode, the operator designates a desired key range of the keyboard 1*b* by setting the lowest key of the key range (hereinafter referred to as "low point LP") and the highest key of the key range (hereinafter referred to "high point HP") in the following manner. At the beginning of the operation of the apparatus G in this mode, a display such as that shown in FIG. 4-(*b*) is made on the display section 15. In this case, the characters "LP" are blinked. The characters "LP=D2, HP=F5" indicate that the low and high points LP and HP immediately before the power-off of the apparatus were "D2" and "F5", respectively, wherein the "D2" and the "F5" represent the "D" note in the second octave of the keyboard 1*b* and the "F" note in the fifth octave of the keyboard 1*b*, respectively. In this condition, when the operator depresses the down-command key 13*b* (FIG. 3) once, the characters "D2" displayed on the display section 15 are changed to "C#2". And when the operator repeatedly depresses the down-command key 13*b* thereafter, the characters displayed on the display section 15 change from "C#2" to "C2", from "C2" to "B1", from "B1" to "A#1" and so on. Thus, each time the down-command switch 13*b* is depressed, the characters indicative of the low point LP are changed to those representative of the next-lower note. On the other hand, each time the up-command switch 13*c* is depressed, the characters indicative of the low point LP are changed to those representative of the next-higher note. In this manner, the operator sets a desired low point LP by means of the down-command switch 13*b* and the up-command switch 13*c*. Upon completion of the setting of the low point LP, the operator depresses the alteration switch 13*d* provided on the operating section 13. Once the alteration switch 13*d* is depressed, the characters "LP" displayed on the display section 15 cease from blinking, and instead of this the characters "HP" start to blink. In this condition, the operator sets a high point HP in a manner described for the setting of the low point LP. The foregoing is the operation of the apparatus G performed when the down-command and up-command switchs 13*b* and 13*c* are operated to set the low and high points LP and HP. Each of the musical tone generating apparatuses G1, G2, G3, . . . is also so constructed that the low and high points LP and HP can be set through the keyboard 1*b* of the electronic keyboard musical instrument 1 of FIG. 1. More specifically, for example, if the B1 key (the key corresponding to the note "B" of the first octave) of the keyboard 1*b* is depressed when the characters "LP" are blinking, the note "B1" is automatically set to the apparatus G as the low point LP and at the same time the characters "LP=B1" are displayed. Likewise, for example, if the G6 key is depressed when the characters "HP" are blinking, the note "G6" is automatically set to the apparatus as the high point HP and at the same time the characters "HP=G6" are displayed.

Upon completion of the setting of the low and high points LP and HP, low point data LPD representative of the low point LP and high point data HPD representative of the high point HP are stored into the RAM 18, both of the low and high point data being in the form of key codes KC.

Figure 5:
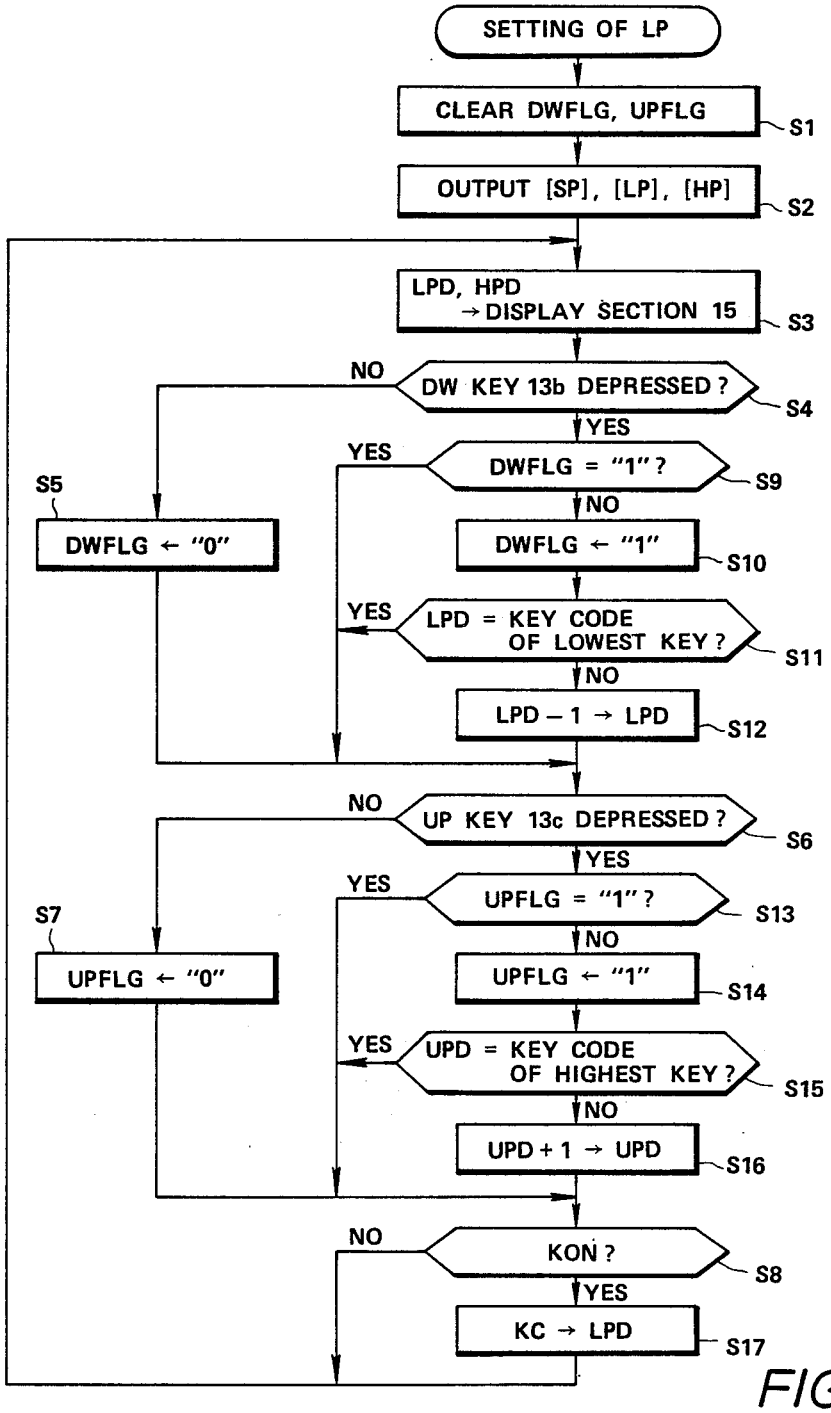
FIG. 5 is a flow chart of the processing performed by the CPU 11 of the apparatus of FIG. 2 in the key range setting mode.

FIG. 5 is a flow chart showing the operation of the apparatus G for setting the low point LP. When the apparatus begins to operate in the key range setting mode, the processing by the CPU 11 proceeds to step S1 at which a down flag DWFLG and an up flag UPFLG both provided in the RAM 18 are cleared. Then, the processing proceeds to step S2. At the step S2, data representative of the characters "SP", "LP" and "HP" are outputted to the display section 15. As a result, the characters "SP", "LP" and "HP" are displayed on the display section 15. Then, the processing proceeds to step S3 at which the low point data LPD and the high point data HPD contained in the RAM 18 are converted into character data which are then supplied to the display section 15. As a result, the display of the characters such as those shown in FIG. 4-(*b*) is made on the display section 15. In this case, the characters "LP" are blinked. The low point data LPD and the high point data HPD used in the above processing are those contained in the RAM 18 immediately before the power-off of this system. At the next step S4, it is judged whether the down-command switch 13*b* is depressed or not. If the judgement result is "NO", the processing proceeds to step S5 at which the down flag DWFLG is reset to "0", and then the processing proceeds to step S6. At this step S6, it is judged whether the up-command switch 13*c* is depressed or not. If the result of this judgement is "NO", the processing proceeds to step S7 at which the up flag UPFLG is reset to "0", and then the processing proceeds to step S8. At the step S8, it is judged whether any key of the keyboard 1*b* of the keyboard instrument 1 is depressed. As described before, when a key is depressed, a corresponding key code signal KC and a key-on signal KON are outputted from the instrument 1 through the electric terminal 1*a*, and the key code KC and the key-on data KON are stored into the registers R1 and R2 provided in the input/output interface circuit 17 shown in FIG. 2. And therefore, at the step S8, the contents of these registers are examined. When the judgement result at the step S8 is "NO", the processing returns to the step S3.

As described above, in the key range setting mode, the CPU 11 first carries out the processings of the steps S1 and S2 and then repeatedly carries out the processings from the step S3 to the step S8 until any one of the down-command switch 13*b*, the up-command switch 13*c* and the keys of the keyboard 1*b* is depressed. And if the down-command switch 13*b* is depressed, the judgement result at the step S4 becomes "YES", so that the processing proceeds to step S9. At this step S9, it is judged whether the down flag DWFLG is in the state of "1". When the result of this judgement is "NO", the processing proceeds to step S10 to set the down flag DWFLG to "1". At the next step S11, it is judged whether the low point data LPD stored in the RAM 18 is equal to the key code KC of the lowest key of the keyboard 1*b*. If the judgement result at the step S11 is "NO", the processing proceeds to step S12 at which the low point data LPD is decremented by one. The processing then returns to the step S3 through the steps S6 to S8. When the processing of the step S3 is carried out, the characters "LP=D2" displayed as shown in FIG. 4-(*b*) are changed to "LP=C#2". Then, at the next step S4, it is judged whether the down-command switch 13*b* is being depressed. If it is judged that the down-command switch 13*b* is being depressed, the processing proceeds to the next step S9. In this case, the judgement result at the step S9 is "YES", so that the processing proceeds to the step S6. And thereafter, the processings of the steps S6, S7, S8, S3, S4, S9 and S6 are repeatedly carried out until the down-command switch 13*b* is released. When the down-command switch 13*b* is released, the result of the judgement at the step S4 becomes "NO", so that the processing proceeds to the step S5 at which the down flag DWFLG is reset to "0". Then, the processing returns to the step S4 through the steps S6 to S8 and the step S3. And thereafter, in a manner similar to the above, each time the down-command switch 13*b* is depressed, the low point data LPD is decremented by one and the characters displayed on the display section 15 are changed in accordance with the decrement of the low point data LPD. And when the low point data LPD coincides with the key code KC of the lowest key of the keyboard 1*b*, the judgement result at the step S11 becomes "YES", so that the step S12 is skipped.

On the other hand, when the up-command switch 13*c* is depressed, the judgement result at the step S6 becomes "YES", so that the processing proceeds to steps S13 to S16. The processings of these steps S13 to S16 are similar to those of the steps S9 to S12, and therefore the description thereof is omitted here.

When any key on the keyboard 1*b* of the musical instrument 1 is depressed during the processing for setting the low point LP, the result of the judgement at the step S8 becomes "YES", so that the processing proceeds to step S17. At this step S17, the key code KC loaded to the register R1 of the input/output interface circuit 17 is read therefrom and stored into the RAM 18, whereby the low point LP corresponding to the depressed key on the keyboard 1*b* is set to the apparatus G. The setting of the low point LP made in response to the depression of a key on the keyboard 1*b* has a higher priority than that made in response to the depression of the down-command and up-command switches 13*b* and 13*c*. More specifically, when a key on the keyboard 1*b* is operated after the down-command switch 13*b* or the up-command switch 1*c* has been operated, the low point data LPD stored in the RAM 18 becomes the key code KC of the operated key.

The foregoing is the processing performed by the CPU 11 to set the low point LP. When the alteration switch 13*d* on the operating section 13 is depressed after the completion of the setting of the low point LP, the characters "HP" displayed on the display section 15 begin to blink and setting operation of the high point HP is enabled. Processing performed by the CPU 11 for setting the high point HP is substantially the same as that for setting the low point LP. And, by the processing of the CPU 11 for setting the high point HP, high point data HPD is stored into the RAM 18.

It should be noted that each of the apparatuses G1, G2, G3, . . . can be of such a modified configuration that the low point data LPD or the high point data HPD is sequentially changed by a step of one at a predetermined time interval while the down-command switch 13*b* or the up-command switch 13*c* is kept depressed, respectively. The above apparatus can be of a further modified configuration that when a key on the keyboard 1*b* is once depressed during the operation for setting the low point LP or the high point HP, the succeeding depressions of keys on the keyboard 1*b* are ignored.

(3) Playing mode

If the function switch 13*a* is depressed during the time when the characters "SP" shown in FIG. 4-(*b*) are displayed on the display section 15, the display on the display section 15 is changed to that shown in FIG. 4-(*c*). The characters "MS" displayed on the display section 15 indicate that the apparatus G is now operating in the playing mode. In this condition, if the function switch 13*a* is depressed again, the mode of operation of this apparatus G returns to the aforesaid tone color setting mode, so that a display is made on the display section 15 as shown in FIG. 4-(*a*). And thereafter, each time the function switch 13*a* is depressed, the mode of operation of the apparatus G is changed from one to another.

In the playing mode, the musical tone signals S are generated in accordance with the key code signals KC, key-on signals KON and the key-off signals KOFF all supplied from the keyboard musical instrument 1 and the low point and high point data LPD and HPD stored in the RAM 18, in the following manner.

Figure 6:
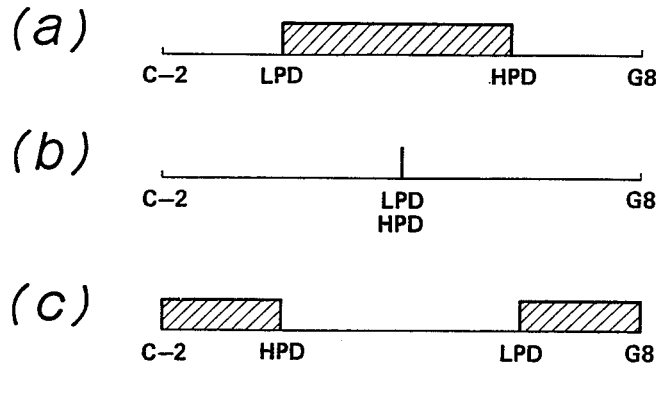
FIGS. 6-(*a*) to 6-(*c*) are illustrations showing the relations between the generation of musical tone signals and the low and high point data LPD and HPD.

First, the relation between the generation of the tone signal S and the low and high point data LPD and HPD will be described. In the case where the low point data LPD is smaller than the high point data HPD as shown in FIG. 6-(*a*), only when the key code KC supplied from the musical instrument 1 is equal to or greater than the low point data LPD and equal to or smaller than the high point data HPD (i.e., $LPD \leqq KC \leqq HPD$), a tone signal S corresponding to the supplied key code KC is generated. On the other hand, in the case where the low point data LPD is equal to the high point data HPD as shown in FIG. 6-(*b*), only when the supplied key code KC is equal to the low point data LPD or the high point data HPD, a tone signal S corresponding to the key code KC is generated. And, in the case where the high point data HPD is smaller than the low point data LPD as shown in FIG. 6-(*c*), only when the supplied key code KC is equal to or smaller than the high point data HPD or equal to or greater than the low point data LPD, a tone signal S corresponding to the key code KC is generated. In FIG. 6, the characters "C-2" and "G8" represent the "C" note of the −2nd octave and the "G" note of the 8th octave and correspond to the lowest-note key and the highest-note key of the keyboard 1*b*, respectively. The hatched ranges in FIGS. 6-(*a*) and 6-(*c*) represent the designated key ranges.

Figure 7:
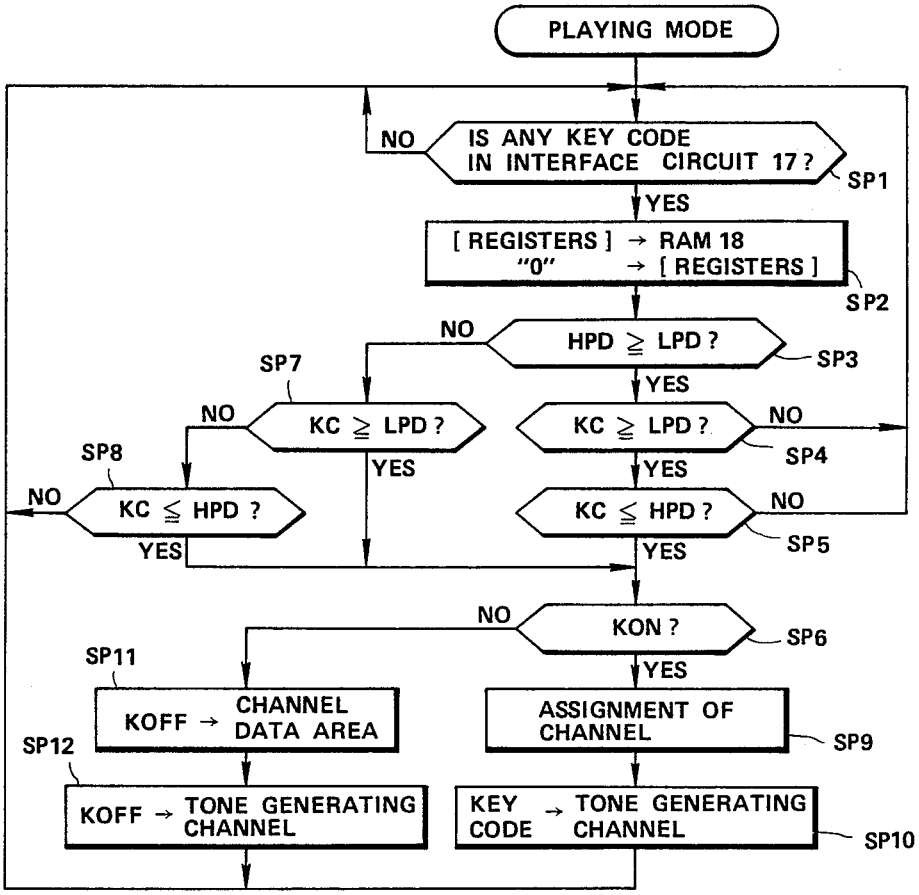
FIG. 7 is a flow chart of the processing performed by the CPU 11 of the apparatus of FIG. 2 in the playing mode.

The processing performed by the CPU 11 in the playing mode will now be described with reference to a flow chart shown in FIG. 7. When the apparatus G begins to operate in this playing mode, the CPU 11 first carries out the processing of step SP1 to judge whether any key code KC is stored in the register of the input/output interface circuit 17. If the result of this judgement is "NO", then the processing of this step SP1 is repeated. In this condition, if a key of the keyboard 1*b* of the instrument 1 is depressed, a key code of the depressed key (it is assumed here this key code is KC-A) is stored into the register R1 of the input/output interface circuit 17, whereupon the judgement result at the step SP1 becomes "YES", so that the processing proceeds to step SP2. At the step SP2, the data in the registers of the input/output interface circuit 17, that is to say, the key code KC-A and the key-on data KON, are transferred to the RAM 18, and then these registers are cleared. At the next step SP3, it is judged whether the high point data HPD stored in the RAM 18 is equal to or greater than the low point data LPD. If the result of this judgement is "YES", that is, in the case of FIGS. 6-(*a*) and 6-(*b*), the processing proceeds to step SP4 at which it is further judged whether the key code KC transferred to the RAM 18 is equal to or greater than the low point data LPD. If the judgement result at this step SP4 is "NO", that is, the key code KC is smaller than the low point data LPD wherein the musical tone signal S should not be generated (see FIG. 6-(*a*)), the processing returns to the step SP1. On the other hand, if the judgement result at the step SP4 is "YES", the processing proceeds to step SP5. At the step SP5, it is determined whether the key code KC is smaller than or equal to the high point data HPD. If the result of this judgement is "NO", that is to say, the key code KC is greater than the high point data HPD wherein the musical tone signal should not be generated, the processing returns to the step SP1. On the other hand, if the judgement result is "YES", the processing proceeds to the next step SP6.

Figure 8:
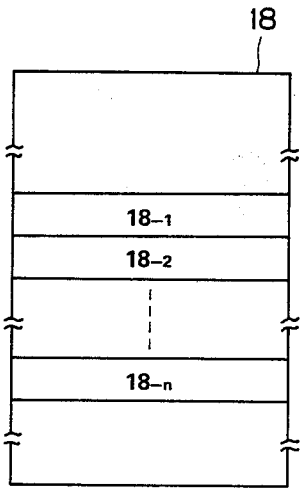
FIG. 8 is an illustration showing the channel data areas 18-1 to 18-n provided in the RAM 18 of the apparatus of FIG. 2.

If the judgement result at the aforesaid step SP3 is "NO", that is, in the case of FIG. 6-(*c*), the processing proceeds to step SP7. At this step SP7, it is judged whether the key code KC transferred to the RAM 18 is greater than or equal to the low point data LPD. If the result of this judgement is "YES", that is to say, the tone signal S should be generated (see FIG. 6-(*c*)), the processing proceeds to step SP6. On the other hand, if the judgement result at the step SP7 is "NO", the processing proceeds to step SP8. At the step SP8, it is judged whether the key code KC is smaller than or equal to the high point data HPD. If the result of this judgement is "NO", that is, the tone signal S should not be generated, the processing returns to the step SP1, and if the judgement result is "YES", that is, the tone signal S should be generated, the processing proceeds to the step SP6. At this step SP6, it is judged whether the data transferred to the RAM 18 with the key code KC was the key-on data KON. If the result of this judgement is "YES", that is to say, the data was the key-on data KON, the processing proceeds to step SP9. In the RAM 18, as shown in FIG. 8, there is provided channel data areas 18-1 to 18-n equal in number to the tone generating channels 20-1 to 20-n each for storing the key code KC, key-on data KON and key-off data KOFF for the tone generating channel assigned thereto. At the step SP9, the key code KC-A and the key-on data KON are stored into one of the channel data areas 18-1 to 18-n which has not yet been assigned any one of the tone generating channels 20-1 to 20-n.

Thus, an assignment of the idling tone generating channel 20-*i* ("i" is one of "1" to "n") to the channel data area 18-*j* ("j" is one of "1" to "n") is established. Then, at the next step SP10, the key code KC-A stored in the channel data area 18-*j* is transferred to the tone generating channel 20-*i* assigned thereto at the step SP9. As a result, the tone generating channel 20-*i* supplied with the key code KC-A generates a tone signal S corresponding to the key code KC-A and feeds the tone signal S to the loudspeaker 5 (see FIG. 1) to thereby produce a musical sound. Upon completion of the processing of the step SP10, the processing again returns to the step SP1, and the processing of the step SP1 is repeatedly carried out thereafter until any operation of the keyboard 1*b* is performed.

When the key of the keyboard 1*b* corresponding to the key code KC-A is released, the musical instrument 1 outputs the key code KC-A together with a key-off data KOFF which are in turn stored into the registers R1 and R3 of the input/output interface circuit 17. At this time, the result of the judgement performed at the step SP1 becomes "YES", and therefore the processing of the step SP2 is carried out. Then the processing proceeds to the step SP6 through the various judgement steps including the step SP3. In this case, the judgement result at the step SP6 becomes "NO", so that the processing proceeds to the step SP11 at which the key-off data KOFF is written into the channel data area 18-*j* of the RAM 18 in which the key code KC-A has been stored. At the next step SP12, the key-off data KOFF is transferred from the channel data area 18-*j* to the tone generating channel 20-*i* which is producing the tone signal S corresponding to the key code KC-A. A. As a result, the tone signal S generated by the tone generating channel 20-*i* begins to decay. When the processing at the aforesaid step SP12 is completed, the processing again returns to the step SP1.

Figure 9:
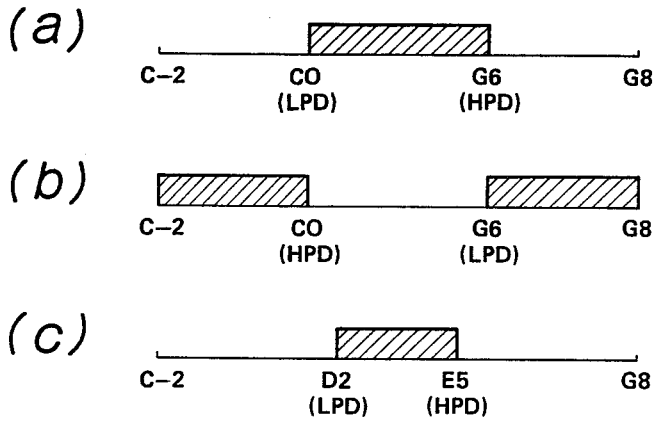
FIGS. 9-(*a*) to 9-(*c*) are illustrations showing examples of the key ranges set respectively on the apparatuses G1, G2 and G3 of the system of FIG. 1.

As described above, each of the musical tone generating apparatuses G1, G2, G3, . . . generates a tone signal S only when a key within the key range designated therein is depressed on the keyboard 1*b*, that is to say, only when a key code KC corresponding to a key within the key range is inputted. And therefore, if the key ranges shown in FIGS. 9-(*a*), 9-(*b*) and 9-(*c*) are designated respectively in the musical tone generating apparatuses G1, G2 and G3, the musical tone generating apparatus G1 generates tone signals S only when keys within the note range of C0 to G6 are depressed, the musical tone generating apparatus G2 generates tone signals S only when keys within the note range of C-2 to C0 or within the note range of G6 to G8 are depressed, and the musical tone generating apparatus G3 generates tone signals only when keys within the note range of D2 to E5 is depressed. In this case, if different tone colors are designated to the musical tone generating apparatuses G1 to G3, musical sounds whose tone color varies in accordance with the key ranges can be produced.

The above described musical tone generating apparatus G may be of a modified configuration that the musical tone parameters to be stored in the tone-color RAM 19 are supplied from the musical instrument 1. In this case, the musical tone parameters designated in the musical instrument 1 may be intactly supplied to musical tone generating section 20. Alternatively, each of the musical tone generating apparatuses G1, G2, G3, . . . may be of a modified construction so as to comprise a switch circuit for designating musical tone parameters and to supply the musical tone parameters designated by the switch circuit to the tone-color RAM 19 or the musical tone generating section 20.

With the aforesaid musical tone generating apparatus G, the generation of tone signals is made only in response to the key information which corresponds to a key within the designated key range, so that a music can be played in versatile fashion. The musical tone generating apparatus according to the present invention is also advantageous in that the keyboard musical instrument system can be extended by connecting further musical tone generating apparatuses in a simple manner.

What is claimed is:

1. For use with an electronic musical instrument having a keyboard, a musical tone generating apparatus responsive to key information signals representing depressed keys of the keyboard for generating a musical tone signal in accordance with the supplied key information signals comprising:

(a) key range designation means for designating a key range of the electronic musical instrument;

(b) determination means for receiving the key information signals and determining whether each key information signal corresponds to a key within said key range to output a determination result;

(c) selector means for selectively outputting said key information signals in accordance with said determination result; and (d) tone signal generating means responsive to said selectively outputted key information signals to generate a musical tone signal corresponding thereto separate from musical tone signals generated by the electronic musical instrument in response to the depression of keys.

2. A musical tone generating apparatus according to claim 1, wherein said key range designation means comprises setting means for setting the highest and the lowest keys of said key range independently from each other.

3. A musical tone generating apparatus according to claim 2, wherein (a) said elector means outputs a key information signal to said tone signal generating means when the key represented by said key information signal is equal to or lower than the highest key of said key range and equal to or higher than the lowest key of said key range if the tone value of the key set as said highest key is equal to or higher than the tone value of the key set as said lowest key, and (b) said selector means outputs said key information signal to said tone signal generating means when the key represented by said key information signal is equal to or lower than the highest key of said key range or equal to or higher than the lowest key of said key range if the tone value of the key set as said highest key is lower than the tone value of the key set as said lowest key.

4. A musical tone generating apparatus according to claim 3, wherein said setting means comprises manual selection means for selecting one of one highest and the lowest keys of said key range, an up-command key means for changing the selected one of the highest and the lowest keys of said key range to the next-higher key and a down-command key means for changing the selected one of the highest and the lowest keys of said key range to the next-lower key.

5. A musical tone generating apparatus according to claim 4, wherein said setting means further comprises display means for displaying names of the highest and the lowest key of said key range.

6. A musical tone generating apparatus according to claim 5 further comprising input terminal means connectable to an electronic keyboard musical instrument through a signal cable for receiving the key information signals from said electronic keyboard musical instrument, said setting means further responsive to a received key information signal for rendering the key represented by one received key information signal the highest key of said key range when the highest key is selected by said manual selection means, said setting means rendering the key represented by another received key information signal the lower key of said key range when the lowest key is selected by said manual selection means.

7. A musical tone generating apparatus according to claim 6 further comprising output terminal means connectable to another musical tone generating apparatus of the same construction as said musical tone generating apparatus for outputting the received key information signals to said another musical tone generating apparatus.

8. A musical tone generating apparatus for use with an electronic musical instrument which generates musical tones and has a plurality of keys which are depressed to generate key information signals representative of depressed keys, the tone generating apparatus comprising:

designation means for designating a portion of the keys as a key range;

determination means for determining whether any of the key information signals generated by the electronic musical instrument corresponds to keys in the key range;

selector means for selectively outputting key information signals which are determined to be in the key range; and tone signal generating means responsive to the selectively outputted key information signals to generate a musical tone signal corresponding thereto separate from musical tones generated by the electronic musical instrument.

9. In a musical tone generating apparatus which is independent and separate from an electronic musical instrument having a plurality of keys and generating key information signals, said musical tone generating apparatus receiving said key information signals and generating musical tone signals separate from tone signals generated by the electronic musical instrument in response to depression of keys of the electronic musical instrument, the improvement wherein the tone generating apparatus includes means for selectively restricting the operation thereof and selectively setting a key range thereof that includes a variable number of less than all of the keys of the electronic musical instrument to generate tones only in response to the depression of keys of the electronic musical instrument within the selected key range.

* * * * *